United States Patent [19]

Carpenter et al.

[11] Patent Number: 4,757,648

[45] Date of Patent: Jul. 19, 1988

[54] ROCKER BARREL CONFIGURATION

[75] Inventors: James H. Carpenter, Hagerstown, Md.; Donald M. Barnhart, Martinsburg, W. Va.

[73] Assignee: Pangborn Corporation, Hagerstown, Md.

[21] Appl. No.: 892,438

[22] Filed: Aug. 4, 1986

[51] Int. Cl.[4] ..... B24C 3/30

[52] U.S. Cl. ..... 51/423; 51/164.1; 51/313; 366/228; 241/183; 164/404; 209/293; 209/407

[58] Field of Search ..... 51/163.1, 164.1, 164.5, 51/410, 417, 419, 422, 423, 426, 313; 241/176, 183, 284; 366/228; 164/401, 404; 209/287, 288, 293, 294, 406, 407

[56] References Cited

U.S. PATENT DOCUMENTS

| | | | |
|---|---|---|---|
| 1,085,109 | 1/1914 | Carman | 241/183 X |
| 1,697,240 | 1/1929 | Hartzell | 51/164.1 X |
| 1,946,440 | 2/1934 | Herrmann | 51/313 X |
| 2,131,768 | 10/1938 | Turnbull | 51/422 |
| 2,424,955 | 7/1947 | Potter | 51/423 |
| 2,836,400 | 5/1958 | Jackson | 51/164.1 X |
| 3,118,253 | 1/1964 | Setzler | 51/163.1 X |
| 3,716,470 | 2/1973 | Noonan | 134/159 X |
| 3,767,554 | 10/1973 | Noonan | 134/159 X |
| 3,948,003 | 4/1976 | Pletscher | 51/164.1 |
| 4,047,334 | 9/1977 | Kuehn | 51/422 |
| 4,319,624 | 3/1982 | Weis et al. | 164/401 |
| 4,382,682 | 5/1983 | Mendenhall | 366/228 X |
| 4,430,003 | 2/1984 | Beattie et al. | 366/228 X |

FOREIGN PATENT DOCUMENTS

| | | | |
|---|---|---|---|
| 2424086 | 11/1975 | Fed. Rep. of Germany | 51/422 |
| 2502531 | 10/1982 | France | 51/422 |
| 129502 | 12/1960 | U.S.S.R. | 51/423 |

*Primary Examiner*—Robert P. Olszewski

*Attorney, Agent, or Firm*—Charles E. Brown

[57] ABSTRACT

A rocker barrel usable in conjunction with a blast stream of abrasives for the cleaning of work pieces. The rocker barrel is of the shallow depth bed type and is mounted for oscillation. The rocker barrel is provided internally with rocker members which will engage both smaller work pieces, such as engine heads, and larger work pieces, such as engine blocks, to effect the tumbling of such work pieces as the rocker barrel oscillates and at the same time maintaining work pieces within the rocker barrel always within the blast stream so as to prevent the blast stream from being directed against the rocker barrel.

8 Claims, 2 Drawing Sheets

ROCKER BARREL CONFIGURATION

This invention relates in general to new and useful improvements in rocker barrel configurations, and more particularly to a rocker barrel for presenting parts to be cleaned to a constant blast stream.

STATEMENT OF PRIOR ART

Machines of this type require a rocker barrel having a relatively deep bed depth before the parts will travel axially through the barrel. U.S. Pat. No. 4,319,624 shows such a rocker barrel configuration. With this type of rocker barrel configuration, internal cleats may not be required because with a deep bed depth, the parts tend to interlock and will produce tumbling. Additionally, to get axial movement of the parts, the barrel is sloped from the entrance to the exit end.

STATEMENT OF INVENTION

This invention particularly relates to a shallow bed depth rocker barrel. Such a barrel, having an axial oscillation conveyor motion, does not require a large bed depth or a slope to move the parts axially. Even a single line of parts can be moved axially and tumbled. The shallow bed depth of the rocker barrel assures that all surfaces of the parts will be presented to the blast stream more efficiently and thus result in higher production rates per horsepower applied to the machine.

On the other hand, a shallow bed depth does present a turnover problem that is overcome in accordance with this invention.

Most particularly, this invention relates to a rocker barrel having a shallow bed depth wherein the configuration of the rocker barrel is one which will assure that the parts tumble, and that some parts are under the blast stream at all times so as to protect the rocker barrel from the direct flow of the blast stream.

Another object of this invention is to provide a means of cleaning a wide range of casting sizes with improved efficiency.

With the above and other objects in view that will hereinafter appear, the nature of the invention will be more clearly understood by reference to the following detailed description, the appended claims, and the several views illustrated in the accompanying drawings.

DRAWINGS

Figure 1:
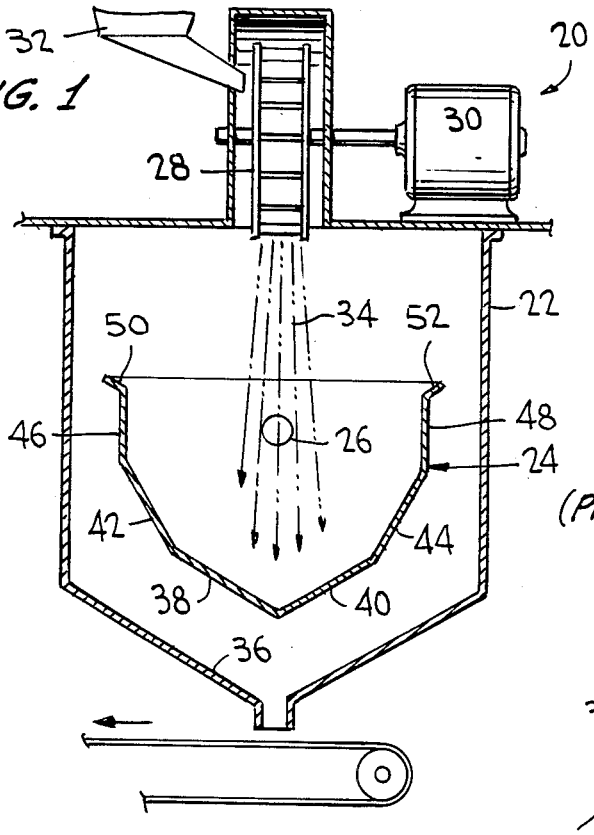
FIG. 1 is a schematic elevational view showing the general relationship of the blast stream with respect to an oscillating rocker barrel.

Referring now to the drawings in detail, it will be seen that there is illustrated in FIG. 1 a typical blast cleaning machine generally identified by the numeral 20. The machine 20 includes a suitable frame 22 in which a rocker barrel 24 is mounted for oscillatory movement about a substantially horizontal axis 26. It is to be understood that the rocker barrel 24 will be rocked by means of a suitable drive mechanism (not shown) which is conventional.

The support frame 22 carries in overlying relation to the rocker barrel a blast unit 28 of the blast wheel type which is driven by a drive unit 30. Abrasives are supplied to the blast wheel through a hopper 32 and the blast wheel directs a blast stream 34 vertically downwardly on opposite sides of a vertical plane passing through the axis 26.

It is to be understood that the rocker barrel 24 will be provided with suitable apertures which will pass the abrasives. Accordingly, the rocker barrel 24 is mounted in a hopper 36 which will be provided with means (not shown) for collecting the abrasive material and returning it to the hopper 32 with, if desired, an intermediate separation of product particles.

Figure 2:
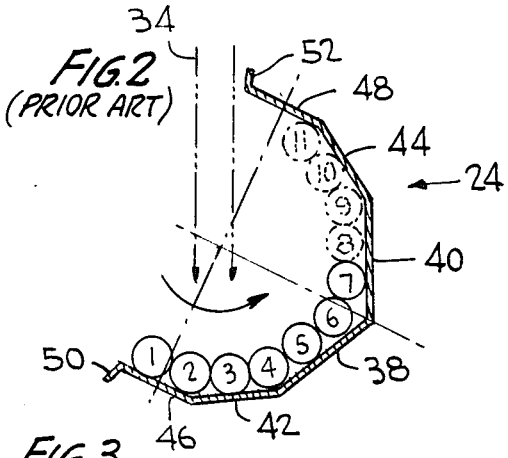
FIG. 2 (PRIOR ART)
FIGS. 2 and 3 are schematic elevational views showing the operation of a shallow depth rocker barrel of a plain configuration.
Figure 3:
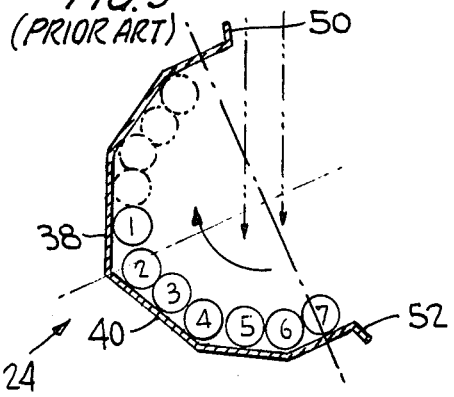
FIG. 3 (PRIOR ART)

At this time it is pointed out that the rocker barrel, which is illustrated in operation in FIGS. 2 and 3, is of a shallow depth in accordance with this invention and is multisided. The illustrated rocker barrel 24 has two bottom sides 38, 40 which are joined together in angular relation. Next there are two further sides 42, 44 which are joined to the bottom sides 38, 40 also in angular relation with respect thereto. Finally, the rocker barrel 24 includes two upper sides 46, 48 which are disposed in parallel relation and which are joined in angular relation to the further sides 42, 44, respectively.

The rocker barrel 24 is also provided with a pair of upper flanges 50, 52.

Referring now to FIGS. 2 and 3, it will be seen that the simple shallow depth bed rocker barrel 24, when provided with a throughput of a limited number of work pieces, for example seven, and when tilted from one extreme where the bottom side 40 is vertical to a further extreme as shown in FIG. 3 where the bottom side 38 is vertical, the seven articles will merely slide across the bottom of the barrel, but will not tumble. It is only when the number of work pieces is increased to, for example, eleven, which is basically an overloading of the rocker barrel, that tumbling will be effected.

Figure 4:
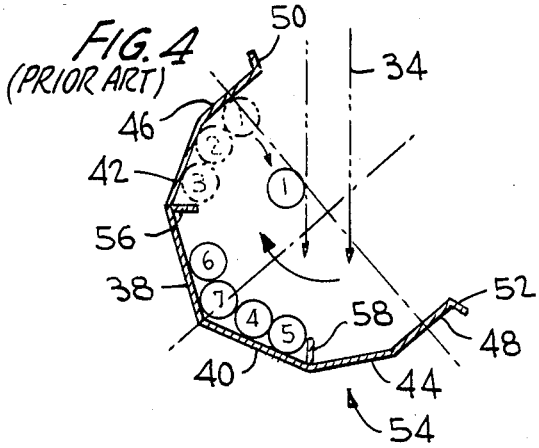
FIG. 4 (PRIOR ART)
FIGS. 4 and 5 are further schematic elevational views showing the operation of a rocker barrel similar to that of FIGS. 2 and 3 but having projecting inwardly thereof bars for producing tumbling.
Figure 5:
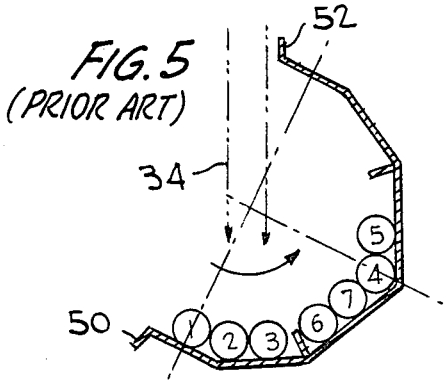
FIG. 5 (PRIOR ART)

Reference is now made to FIGS. 4 and 5 wherein there is illustrated a modification of the rocker barrel 24. This rocker barrel is generally identified by the numeral 54 and is of the same configuration as the rocker barrel 24, but is provided with a pair of bars 56, 58 with the bar 56 being at the intersection of the sides 42 and 38 and the bar 58 being at the intersection of the sides 40 and 44.

It will be seen that when the rocker barrel 54 is oscillated and as is shown in FIG. 4, approaches its clockwise extreme, the three work pieces located to the left of the bar 56 will be tumbled over the four work pieces disposed between the bars 56, 58 and will move from being seated on the sides 42, 46 to being seated on the sides 40, 48.

Then as the rocker barrel 54 is rotated in a counterclockwise, the same three work pieces will be tumbled back to their original positions resting on the sides 42, 46, as is shown in FIG. 5. In the meantime, the four work pieces seated on the sides 38, 40 will merely slide back and forth between the bars 56, 58 and will not be tumbled.

DESCRIPTION OF INVENTION

In accordance with this invention, the rocker barrel 24 is modified so as to include a pair of rocker members or cleats 60, 62 with the rocker barrel being identified by the reference numeral 64.

The cleat or kicker member 60 is triangular in cross section and includes an end abutment surface 66 and a face surface 68. The base of the kicker member 60 is seated on the bottom side 38 with the end abutment surface 66 generally facing the side 42.

In a like manner, the cleat or kicker member 62 has an end abutment surface 70 and a face surface 72 and is triangular in cross section as is the kicker member 60. The kicker member 62 has a base which is secured to the bottom side 40 adjacent the intersection of the bottom side 40 with the side 44. The end abutment surface 70 generally faces the side 44.

In accordance with this invention, the length of the face of each of the abutment members is on the order of two to three times the height of the end abutment surfaces.

Figure 6:
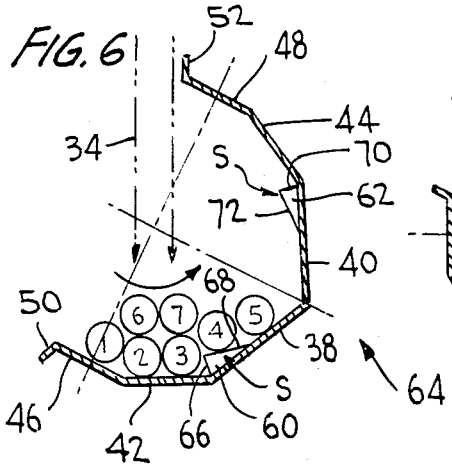
FIGS. 6–11 are schematic elevational views of a rocker barrel formed in accordance with this invention and show how tumbling of the various parts being cleaned is automatically effected.

It will be seen that starting with the tumbled position of FIG. 6, when the rocker barrel 64 is rotated in the clockwise direction to a midpoint, three of the work pieces will be to the left of the kicker member 60 while the other four work pieces will be between the kicker members 60, 62. Then as the rocker barrel 64 is rotated further in a clockwise direction to its extreme position, it will be seen that due to the tapered configuration of the kicker member 62, certain of the work pieces will slide over the kicker member 62 while others of the work pieces which were to the left of the kicker member 60 will be retained by the end abutment surface 66 so as to be tumbled.

Figure 7:
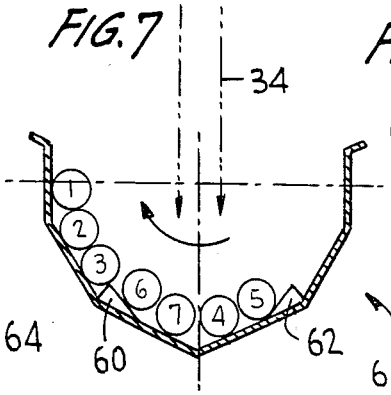
Figure 8:
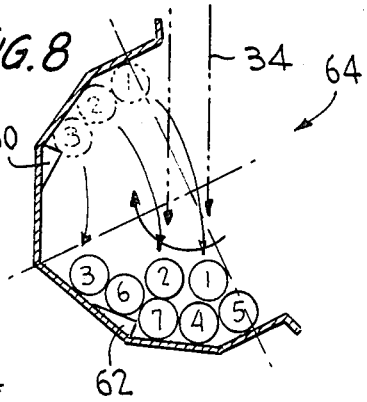
Figure 9:
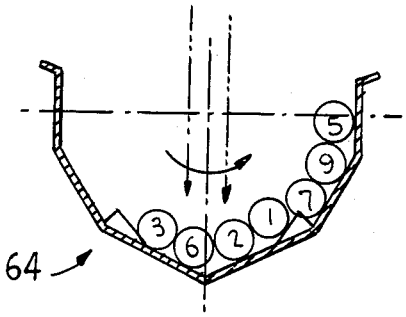

Then, with reference to FIG. 9, it will be seen that when the rocker barrel 64 is again moved in a counterclockwise direction to its midpoint position, there will be four of the work pieces between the kicker members 60, 62, while three of the work pieces will be to the right of the kicker member 62. However, only one of the work pieces which were between the kicker members 60, 62 in FIG. 7 now remains between the kicker members.

Figure 10:
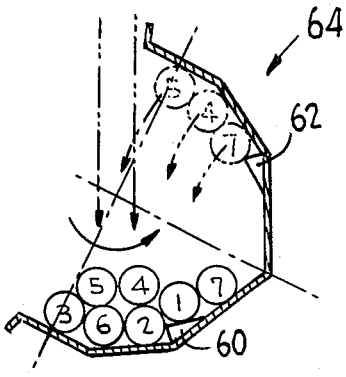
Figure 11:
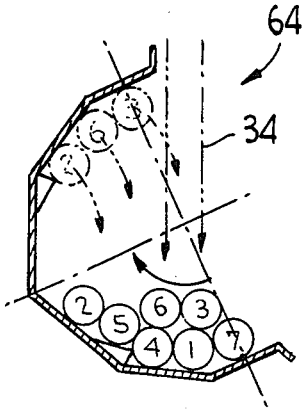

Then as the rocker barrel 64 moves to its extreme position in a counterclockwise direction as shown in FIG. 10, the three work pieces carried by the kicker member 62 will be tumbled while three of the four work pieces disposed between the kicker members 60, 62 will slide to the left of the kicker member 60.

Then as the rocker barrel 64 is again rotated in a clockwise direction a further tumbling and sliding action occurs with the result that not only at all times will there be work pieces in the path of the blast stream 34, but also the work pieces will be effectively tumbled in their travel axially through the rocker barrel 64 so that all faces thereof will be properly blasted and thus cleansed.

It will be apparent from the illustrations of FIGS. 6–11 that the rocker barrel 64 will be effective with respect to smaller work pieces, for example, engine heads. However, the kicker members 60, 62 will not effectively tumble large work pieces, such as engine blocks. Accordingly, reference is here made to FIGS. 12–16 wherein it will be seen that the rocker barrel 64 has been further improved by the provision of a further kicker member 70 extending longitudinally of the rocker barrel at the intersection of the bottom sides 38, 40. This further modified rocker barrel is generally identified by the numeral 74.

The kicker member 70 in cross section has four sides, two of which face the bottom sides 38, 40 and are suitably secured thereto. The other two sides of the kicker member 70 are in the form of end abutment surfaces 76, 78 which face in opposite directions generally towards the sides 42, 44.

Figure 12:
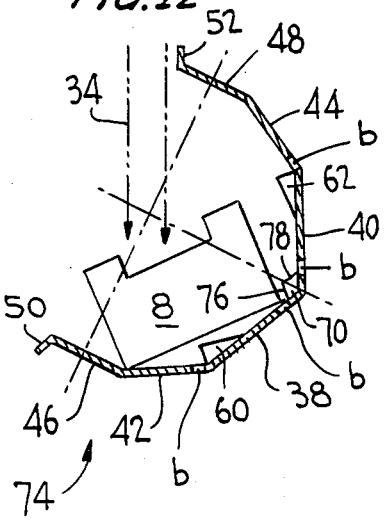
FIGS. 12–16 are further schematic elevational views showing the operation of a rocker barrel similar to that of FIGS. 6–11 but incorporating a further kicker wherein the rocker barrel may be effectively utilized in the cleaning of larger castings wherein tumbling is effected.
Figure 13:
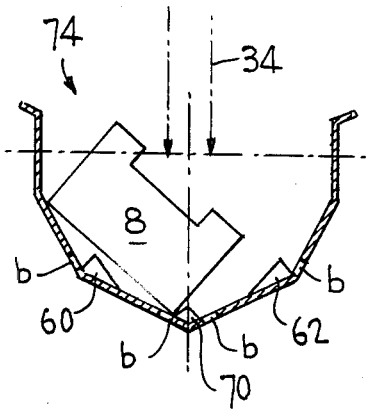
Figure 14:
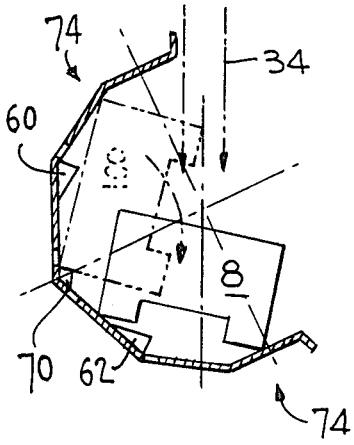

In FIG. 12, the rocker barrel 74 is illustrated as being rotated to an extreme in the counterclockwise direction with the large work piece being disposed to the left of the kicker member 70. When the direction of rotation of the rocker barrel 74 is reversed, the work piece is moved across the blast stream 34 providing for an effective cleaning of a large surface thereof. Then as rotation of the rocker barrel 74 continues in a clockwise direction, to the opposite extreme, the work piece will pivot about the end abutment surface 76 of the kicker member 70 so as to effect the tumbling of the work piece within the path of the blast stream 34 as is shown in FIG. 14.

Figure 15:
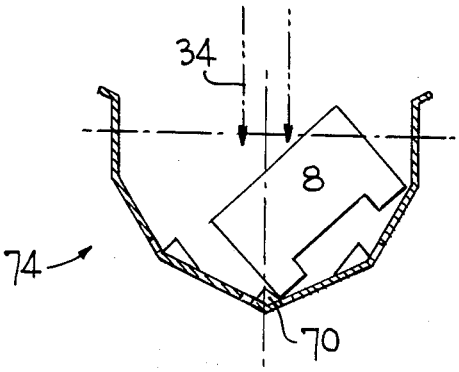
Figure 16:
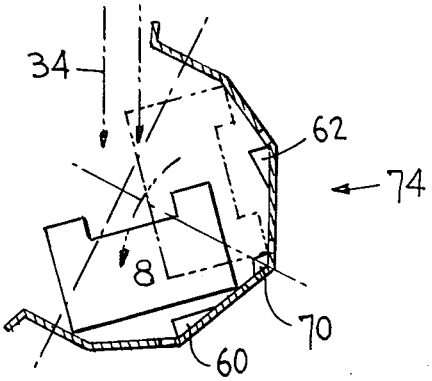

As the rocker barrel 74 next rotates in a clockwise direction, the opposite face of the large work piece will be directed across the blast stream 34 as is shown in FIG. 15 until the rocker barrel 74 again approaches the extreme limits of its counterclockwise rotation at which time the large work piece will engage the end abutment surface 78 of the kicker member 70 and effect further tilting of the large work piece back to approximately its original position shown in FIG. 12. In this manner, all surfaces of the large work piece will be engaged by the blast stream 34 to effectively cleanse the work piece while the work piece travels axially through the rocker barrel 74. At the same time, the work piece constantly shields the rocker barrel from the direct effect of the blast stream 34 so as to restrict the wear of the barrel.

Although no attempt has been made to illustrate the operation of the rocker barrel 74 in conjunction with small work pieces such as those shown in FIGS. 2–11, it is to be understood that the basic operation of the rocker barrel 74 will be the same as that with respect to the rocker barrel 64 and as illustrated in FIGS. 6–11.

Although only a preferred embodiment of the rocker barrel has been specifically illustrated and described herein, it is to be understood that minor variations may be made in the rocker barrel without departing from the spirit and scope of the invention as defined by the appended claims.

We claim:

1. A rocker barrel comprising a multisided open top barrel mounted for oscillation about a generally horizontal axis, said barrel including two bottom sides joined together at a bottom of said barrel, and at least two further sides joined to said two bottom sides, and a sloping kicker carried by each of said bottom sides adjacent said further sides, each of said kickers having an end abutment surface facing a respective one of said further sides and a sloped surface extending from the end abutment surface in a direction toward the joint of the two bottom sides to increase the tumbling movement of the workpieces as the barrel is oscillated.

2. A rocker barrel according to claim 1 wherein each of said kickers is substantially triangular in cross section and includes a top face sloping from said end abutment surface towards a respective one of said bottom sides.

3. A rocker barrel according to claim 2 wherein the length of said top face is on the order of 2 to 3 times the height of said end abutment surface.

4. A rocker barrel according to claim 1 wherein said rocker barrel has two upper sides disposed in substantially parallel relation and being cooperable with said kickers to effect tumbling of work pieces as said barrel oscillates from one extreme to another.

5. A rocker barrel according to claim 1 wherein a further kicker is mounted at the intersection of said two bottom sides.

6. A rocker barrel according to claim 5 wherein said further kicker has oppositely facing end abutment surfaces.

7. A rocker barrel according to claim 5 wherein said further kicker has oppositely facing end abutment surfaces, and is defined by four sides in cross section.

8. A rocker barrel according to claim 1 wherein said rocker barrel is free of a kicker at the bottom of said barrel.

* * * * *